US010119782B2

(12) United States Patent
Erickson

(10) Patent No.: US 10,119,782 B2
(45) Date of Patent: Nov. 6, 2018

(54) CONDITION-SENSING HANDGUN HOLSTER

(71) Applicant: SlideTEK LLC, Poulsbo, WA (US)

(72) Inventor: Arlen J. Erickson, Bainbridge Island, WA (US)

(73) Assignee: SlideTEK LLC, Poulsbo, WA (US)

( * ) Notice: Subject to any disclaimer, the term of this patent is extended or adjusted under 35 U.S.C. 154(b) by 119 days.

(21) Appl. No.: 15/417,183

(22) Filed: Jan. 26, 2017

(65) Prior Publication Data

US 2018/0209761 A1 Jul. 26, 2018

(51) Int. Cl.
*F41C 33/00* (2006.01)
*F41C 33/02* (2006.01)

(52) U.S. Cl.
CPC ..... *F41C 33/029* (2013.01); *F41C 33/0245* (2013.01)

(58) Field of Classification Search
CPC ..... F41C 33/029; F41C 33/0245
USPC ..... 224/192
See application file for complete search history.

(56) References Cited

U.S. PATENT DOCUMENTS 5,916,087 A * 6/1999 Owens ..... F41A 23/18 224/243
6,112,962 A * 9/2000 Matthews ..... F41C 33/0236 224/191
6,230,946 B1 * 5/2001 Vor Keller ..... F41A 17/066 224/244
6,267,279 B1 * 7/2001 Matthews ..... F41C 33/0236 224/191
8,653,974 B2 * 2/2014 Crook ..... G08B 25/10 224/244
2001/0019071 A1 * 9/2001 Vor Keller ..... F41A 17/066 224/244
2001/0048009 A1 * 12/2001 Vor Keller ..... F41A 17/066 224/244
2002/0153396 A1 * 10/2002 French ..... F41C 33/0209 224/244
2002/0158095 A1 * 10/2002 Vor Keller ..... E05B 47/0603 224/244
2007/0271831 A1 * 11/2007 Newkirk ..... F41A 17/06 42/70.01
2013/0200118 A1 * 8/2013 Johnson ..... A45C 11/00 224/246
2014/0291363 A1 * 10/2014 Clifton, Jr. ..... F41C 33/0263 224/244
2015/0184978 A1 * 7/2015 Hedeen ..... F41G 1/35 42/114
2016/0116253 A1 * 4/2016 Moon ..... F41C 33/029 224/244

* cited by examiner

*Primary Examiner* — Peter Helvey
(74) *Attorney, Agent, or Firm* — Galvin Patent Law LLC; Brian R. Galvin

(57) ABSTRACT

A condition-sensing handgun holster has been developed that both allows one-handed loading or unloading of a semi-automatic pistol using a slide mechanism, and that may sense the presence of a firearm in the holster as well as its load state, is described. The holster facilitates firearm loading and unloading through use of a gun slide-arresting mechanism that allows the gun carriage to move relative to the slide, introducing or ejecting a round into or from the chamber. Gun presence in the holster and load state are determined using in-holster sensors. The data may be transmitted to remote monitors.

5 Claims, 16 Drawing Sheets

CONDITION-SENSING HANDGUN HOLSTER

BACKGROUND OF THE INVENTION

Field of the Invention

The disclosure relates to holsters for handguns. Specifically, handgun holsters that attempt to ensure that a round is in the chamber when the handgun has been removed from it.

BACKGROUND OF THE INVENTION

In the art, there exist various holster assemblies that facilitate loading and unloading a round into and out of the chamber of a handgun; examples include U.S. Pat. Nos. 8,752,741 B2, and 8,752,742 B2. Each of these patents discloses an assembly and a method that facilitate this end. The prior art holsters assist in loading and unloading the pistol with one or more springs and slides respectively, storing/releasing elastic potential energy, and guiding the path of the trigger guard. Despite both the existence of holster assemblies that may facilitate loading or unloading of a pistol and other design aspects of holsters, such as improved gun retention, which have increased the safety of those who carry firearms in holsters, even more advanced holsters which are more jam resistant, jamming being a significant issue of current self-loading and unloading holsters, and that may accurately sense the load state of the handgun by tracking the presence of a round in the chamber, thereby increasing handgun safety even further, improvements are needed.

SUMMARY OF THE INVENTION

Accordingly, the inventor has developed a condition-sensing handgun holster that combines a smart holster and jam-resistant slide mechanism with condition sensing technology.

According to a preferred embodiment, a jam-resistant slide is achieved by encapsulating a slide between structural parts of the holster assembly and the pistol. The jam-resistant mechanism ensures that the holster may be used to chamber a round even if the assembly is exposed to performance degrading environmental factors after the pistol is inserted.

According to a preferred embodiment, a condition-sensing handgun holster is disclosed, comprising: a holster body configured to form an enclosure for a firearm; a rigid arm comprising a structural member mounted within the holster body perpendicular to an orientation of a firearm placed within the holster body, and configured to operate at least a loading mechanism of a firearm placed within the holster body by obstructing the movement of at least a mechanical slide of the firearm while allowing movement of the firearm barrel along at least one axis; and a plurality of sensors configured to detect and report the state of a chamber of a firearm placed within the holster body, wherein the sensors are configured to report at least whether the chamber contains a live round of ammunition.

Condition sensing technology comprises at least a computing device using one or more sensors adapted to track when a pistol is loaded, unloaded or removed from the holster. Such sensors may include those that may identify when a round is already in the chamber. An internal storage chip allows condition-sensing technology to store information such that operation may function in an untethered fashion. Further, network adapted transition sensing technology facilitates an alert system based on transitions and may use a variable frequency controller such that operation may function in a tethered fashion. Embodiments may include a sound-producing device adapted to make audible alerts.

BRIEF DESCRIPTION OF THE DRAWINGS

The following drawings will serve to illustrate multiple embodiments of the inventions and assist understanding of the reading, explaining the operations, functions, and improvements that make reference to them. It will be appreciated by one skilled in the art that the particular embodiments illustrated in the drawings are merely exemplary, and are not to be considered as limiting the scope of the invention or the claims herein in any way.

DETAILED DESCRIPTION

Figure 1:
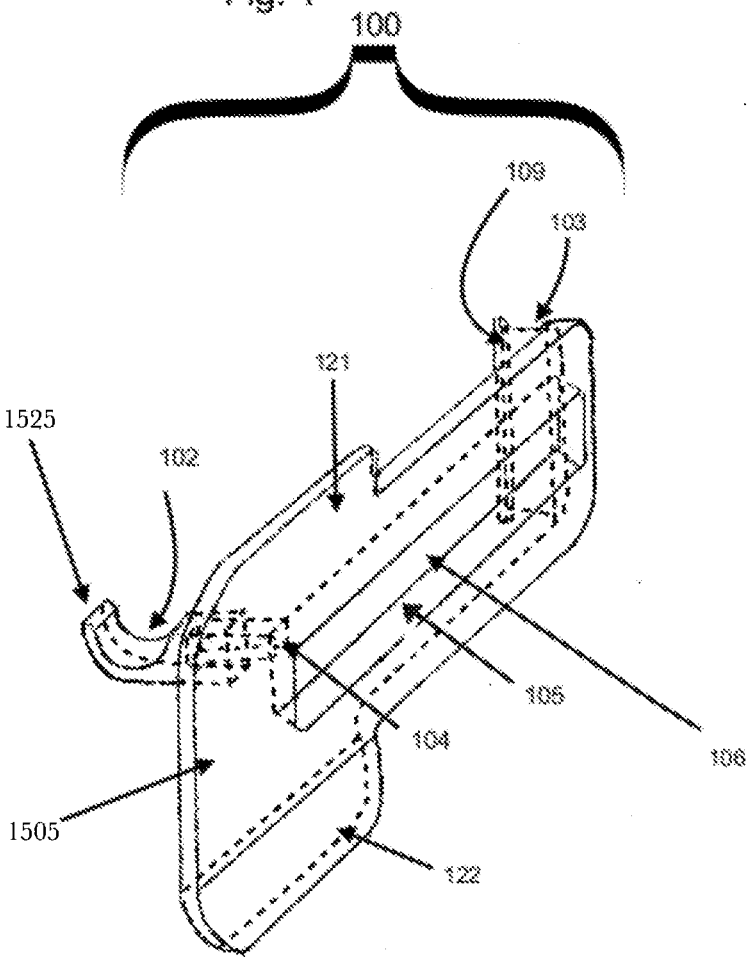
FIG. 1 shows a preferred embodiment of the holster base structure, with invisible lines to help illustrate with an arm, a grove, a cavity, and a sub-cavity.

The detailed description discloses assemblies that not only help load and unload a pistol, but also make it easier to ease the assembly back to its resting position if the user only wants to load the pistol. Some embodiments of the holster assembly include an elastomer. The incorporation of an elastomer into the holster assembly causes it to react to how it is being used. The elastomer reacts to being kept from springing back to its passive position by releasing some of the energy it has stored, as heat. The release of that energy as heat results in the holster assembly handling more easily when eased back to its passive position. A reactive articulation mechanism is formed by application of an elastomer as a return mechanism.

Different elastomers have different qualities. The strength of an articulation mechanism is decided by the specifications of the elastomer employed. In various embodiments, the elastomer employed is in the shape of a band, encircles the slide mechanism, and sits in a groove. In this case, it is very easy to replace the band by taking it from the holster assembly because it only sits in a groove. Replacing one elastomer band with another elastomer band with an elastomer band of different specification may be a mechanism to change the behavior of the holster in the field such as but not limited to for changes in tactical situation or other factors such as weather, although the mention of these few examples should not be construed to limit invention capabilities in any way.

The jam resistant slide mechanism seen in the preferred embodiment is designed to prevent obstructions that may prevent a slide from articulating. The design characteristics disclosed serve to prevent a slide from being the point of failure when the holster is used to load a pistol without otherwise significantly changing the perceived operation of the holster from that of holsters not similarly equipped.

A preferred embodiment of the condition-sensing technology comprises at least a holster and a computing device with one or more sensors adapted to track when a pistol is loaded, unloaded or removed from the holster. An internal storage memory chip allows transition-sensing technology to store information such that operation may function in an untethered fashion. Further, network adapted condition transition sensing technology may allow an alert system based on those transitions to be and may use a variable frequency controller such that operation may function in a tethered fashion. Embodiments may include a sound-producing device adapted to make audible alerts.

One or more different inventions may be described in the present application. Further, for one or more of the inventions described herein, numerous alternative embodiments may be described; it should be appreciated by one skilled in the art that these are presented for illustrative purposes only and are not limiting of the inventions contained herein or the claims presented in any way. One or more of the inventions may be widely applicable to numerous embodiments, as may be readily apparent from the disclosure. In general, embodiments are described in sufficient detail to enable those skilled in the art to replicate one or more of the inventions, and it should be appreciated that other embodiments may be utilized and that structural, material or other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions, nor a listing of features of one or more of the inventions that must be present in all embodiments.

When a single device or article is described herein, it will be readily apparent that more than one device or article may be used in place of a single device or article. Similarly, where more than one device or article is described herein, it will be readily apparent that a single device or article may be used in place of the more than one device or article.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

One or more other devices that are not explicitly described as having such functionality or features may alternatively embody the functionality or the features of a device. Thus, other embodiments of one or more of the inventions need not include the device itself.

In the preferred embodiment, holster assembly is presented as a combination of multiple components; however, there are many modifications obvious to one skilled in the art. In other embodiments, various pieces may be, without limitation combined, subdivided, beveled, fitted, spaced and affixed in a manner to perform the functions of multiple different embodiments. Use of different materials may eliminate the need to execute the functions by certain forms. This enumeration is not meant to limit the modifications. Further, the detailed description of the preferred embodiment should serve to illustrate an embodiment of the innovations described thus far, even without specifically explaining concepts and mechanisms employed.

Detailed Description of Exemplary Embodiment

A person skilled in the art will be aware of a range of possible modifications of the various embodiments. Accordingly, the present invention is defined by the claims and their equivalents.

Figure 15:
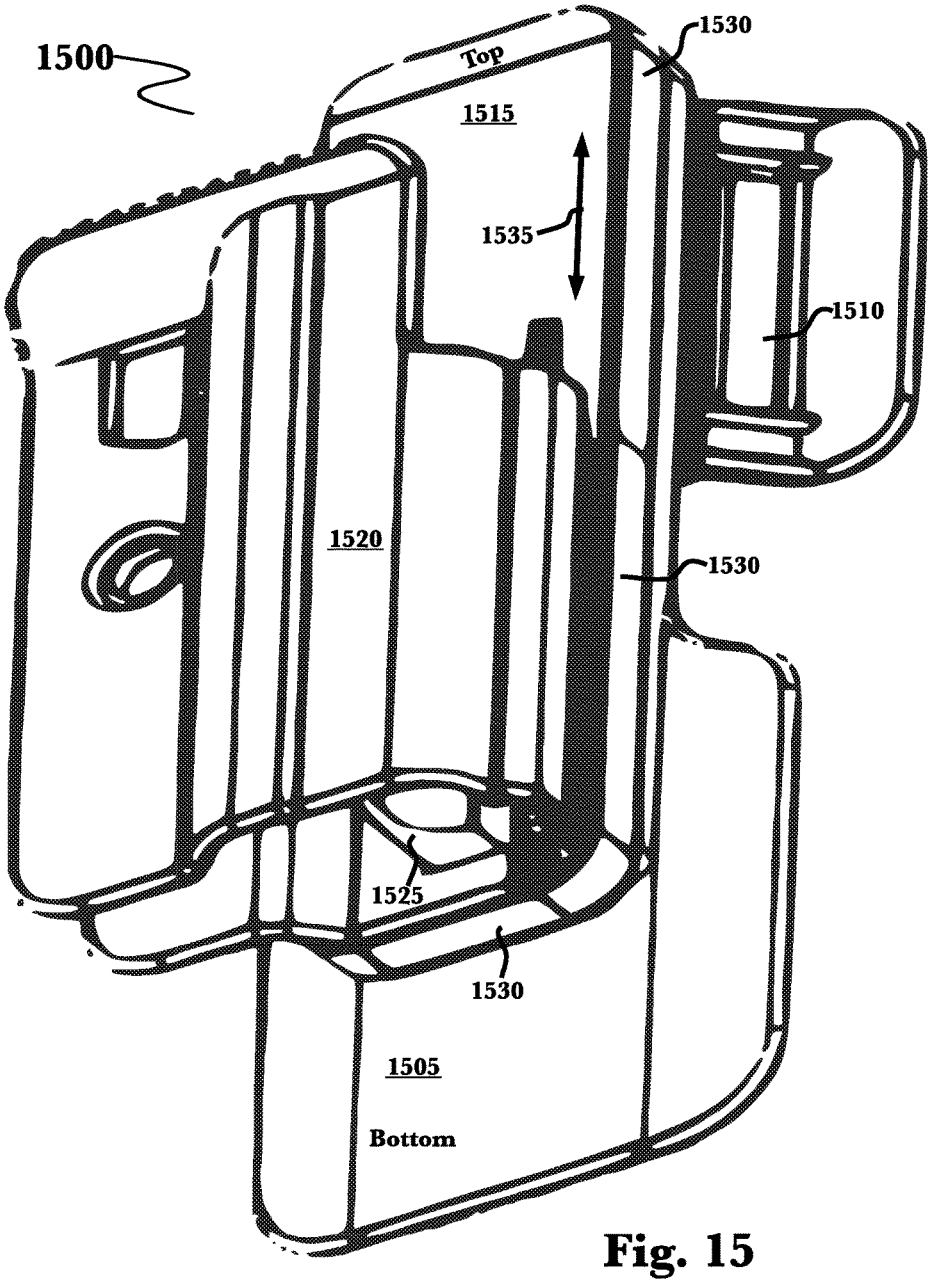
FIG. 15 is a system diagram showing important structure of the condition-sensing holster, according to an embodiment.

FIG. 15 is a system diagram showing important structure of the condition-sensing holster, according to an embodiment 1500. The holster is built upon an injection molded plastic base that forms the surface that may rest against shooter's leg 1505. Molded into this base form are holes through which a belt may be passed (one visible, 1510) to allow the holster to be secured to owner's waist during carry of the handgun holster combination. Above the base is situated a molded platform into which the handgun may be stored, or holstered which is made up of a bottom plastic plate injection molded to securely hold the left side of the gun, assuming a right-side holster 1515, and a molded receiver 1520 which is molded with cut outs to securely accommodate the remainder of the gun while it is stored within the holster. At the bottom of the handgun carriage 1515-1520, is a molded stop which due to the specificity of the holster for the gun, may form a rest that isolates the handgun barrel from the slide 1525. When activated by the shooter, the handgun carriage 1515-1520 may slide downward 1535 over the base plate 1505. The molded handgun stop 1525 is connected to the holster base 1505 and therefore remains stationary as the handgun carriage slides down. The barrel of the gun may move downward through the hole on the handgun stop while the slide, supported by the handgun stop moves towards the back of the gun until movement proceeds to a point where an available round from the magazine is racked into the handgun's chamber, loading the gun. Lessening of the downward force by a shooter releases the pressure placed on an elastomer band that sits in a groove 1525 at the interface between holster base plate 1505 and bottom plate 1515 of handgun carriage 1515-1520 and runs around all sides of the holster 1525 and the elastic counterforce of the elastomer band to the downward force of the shooter activating the round chambering mechanism results in the handgun carriage 1515-1520, returning to its original position near the top of the base plate 1505 with the now-loaded handgun. Unloading of the handgun works very similarly to loading, except that once the slide is fully retracted and the chamber open, there is not a bullet to enter the chamber from the magazine. Further, sensors may be present within the baseplate and receiver of handgun carriage 1515-1520 that record whether the handgun is currently loaded, unloaded or out of the holster. These data may be stored in flash memory which may be present in the holster base 1505 of the embodiment. In certain embodiments, gun status data may also be transmitted wirelessly for near-real-time review using one of the wireless protocols appropriate for the task and known to those skilled in the art, or for later retrospective review which may be transmitted wirelessly or by using a data transfer cable one of data transfer protocols known to those skilled in the field.

Figure 16:
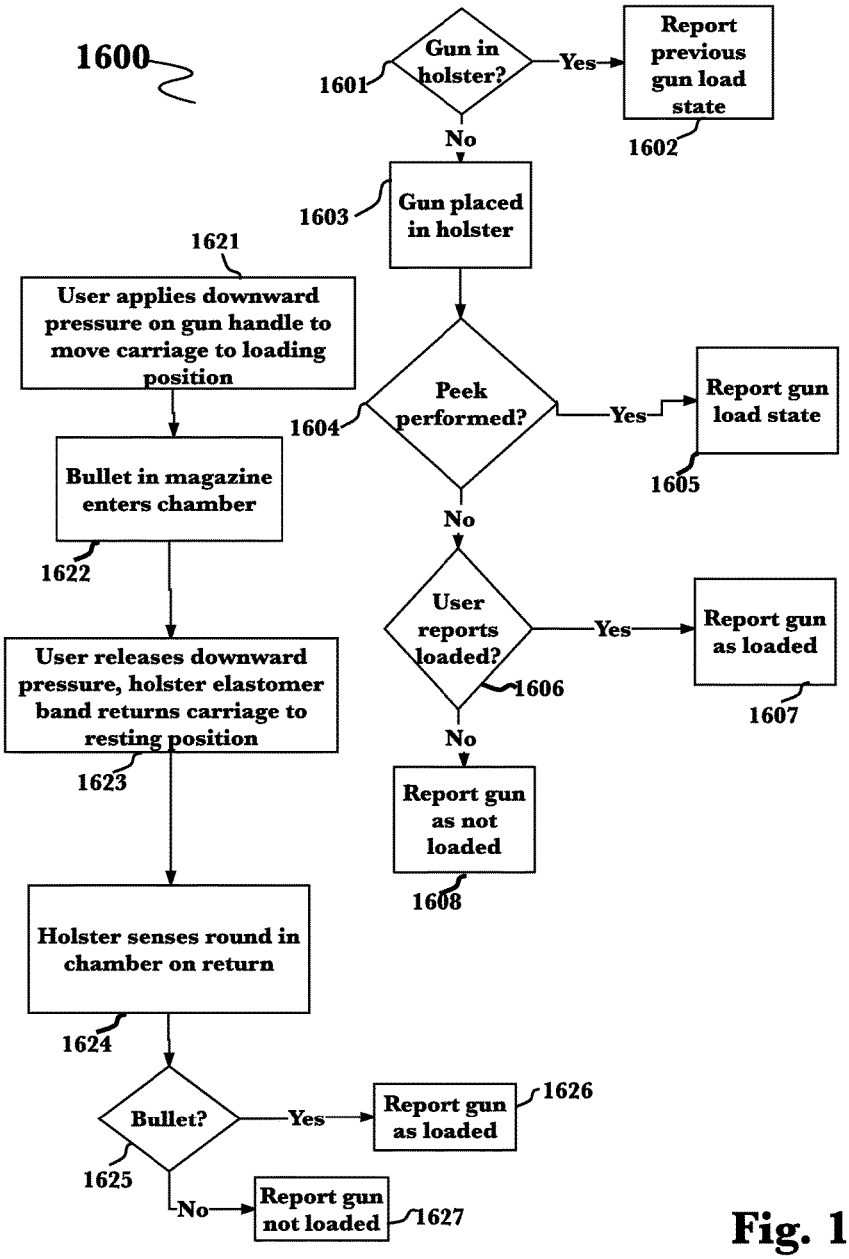
FIG. 16 is a method diagram showing several functional features of a condition-sensing holster, according to an embodiment.

FIG. 16 is a method diagram showing several functional features of a condition-sensing holster, according to an embodiment. On many occasions, a gun owner will retrieve and, depending on the embodiment, re-activate the smart holster with the gun continuously stored within it since the last use. Under this condition, the holster may retain the gun load state from before storage in step 1602. As "unloaded," or without a round in the chamber is safest for unattended storage, that status, "unloaded," may be the default for a handgun in step 1601 introduced to the holster 1603 without any sensor or owner-obtained data 1608. When a gun is introduced into holster in step 1603 which holster may detect, the holster owner may push the gun down towards the bottom of holster in step 1604, depending upon the embodiment, partially through the load process to partially open the chamber which may allow sensors built within the holster, either mechanical or optical, to read the presence of a round. This is one method by which an embodiment may determine a load state of gun in step 1605; otherwise, usually when the gun has a round in the chamber (i.e., is "loaded"), the owner may activate an input, such as a button on the holster to confirm that the gun has a round in the chamber in step 1606; again, the holster may then report the gun as in a "loaded" state in step 1607, possibly by lighting an LED visible to the user, or by changing the status on an LCD display on the holster, among other signaling possibilities familiar to those skilled in the art. Dependent on the embodiment, it is possible that such data may be stored for later review by the owner (or an oversight party), or may be transmitted wirelessly for immediate observation such as to remotely determine gun status. Removal of a gun from a condition-sensing holster may be sensed and reported by holster, starting the discovery process over in step 1601. Some embodiments may include more extensive programming where parameters such as amount of time outside the holster or the occurrence of an acoustic signature of gunfire above a certain decibel level (among other factors known to those skilled in the art), may serve to retain or negate a previous gun status.

Racking a handgun with a condition-sensing holster may involve first pushing semi-automatic handgun, possibly while gripping its handle, until the handgun is fully and correctly placed inside of holster, and then continuing downward towards the bottom of the holster base plate in a direction parallel to that base plate to a stop, in step 1621. This motion retracts the handgun's slide, opening the chamber to the round magazine, allowing a round to enter the receiver from the magazine and to then be guided into chamber in step 1622. The owner eventually will release the downward pressure applied and the elastomer band of the holster will return the holster handgun carriage 1515-1520 to its resting position. This activity may be sensed by condition-sensing holster in step 1623, depending on the embodiment and the gun may then be reported as loaded in step 1626. There are times, as when the magazine is empty and the holster owner either wants to unload the last round from the handgun, or the owner does not realize that the magazine is empty, when the "loading" process 1621, 1623 is exercised. Under this case, the holster may sense that there is no round in the chamber and will report the gun as "not loaded" in step 1627.

FIG. 1 shows a preferred embodiment of the holster base structure, with invisible lines to help illustrate with an arm, a grove, a cavity, and a sub-cavity. An arm 1525 extends from a central body 1505 of molded base 100, to define a surface with its upper side 102 that a pistol's slide cannot pass beyond, when the holster assembly is complete; however, arm 1525 is intentionally shaped to allow a pistol's barrel to traverse it from that direction. Arm 1525 is partially hollow. The hollow space inside arm 1525 is a sub-cavity 104 of a larger cavity 105. Larger cavity 105 contains wall 106 that is parallel to side 1505. The presence of these cavities may allow the holster to be reinforced against shear deformation (see FIG. 2) and may also provide internal space within the holster for sensor and data storage memory placement depending on the embodiment. The molded base also has a groove 103 which forms the top surface of the elastomer band guide in the assembled holster. The base plate may also include a set of molded stabilization wings 121 and 122. For certain embodiments, one or both wings may serve as anchor areas for battery compartments or for protective compartments for electronics, such as, but not limited to, wireless network transceivers, among other possible additions familiar to those skilled in the art.

Figure 2:
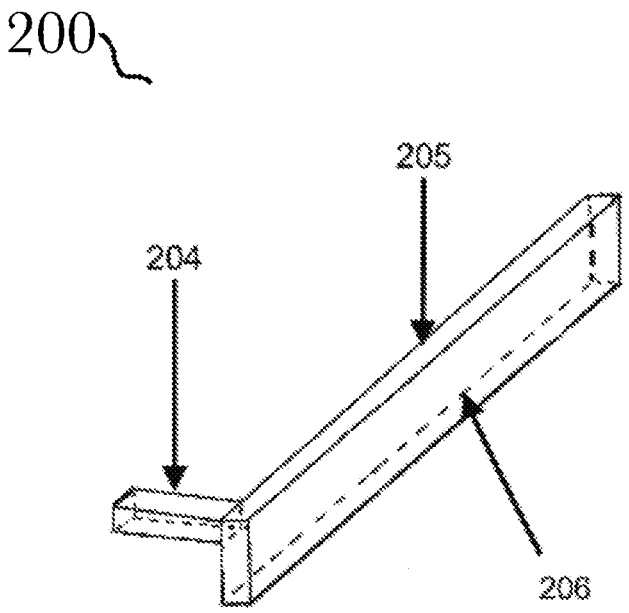
FIG. 2 shows a preferred embodiment of a reinforcement armature component of the condition-sensing holster, with invisible lines disclosing proximal structures.

FIG. 2 shows a preferred embodiment of a reinforcement armature component of the condition-sensing holster, with invisible lines disclosing proximal structures. FIG. 2 depicts a blued steel aperture 200, has a steel arm 204 and a steel body 205 that fit into sub cavity 104 and cavity 105 respectively. Steel body 205 has a side 206, which sits flush to the inner edges of side 210. When affixed in the molded base, steel armature 200 prevents shear deformation to molded arm 1525 and provides a bracket for mounting other components of the assembly.

Figure 3:
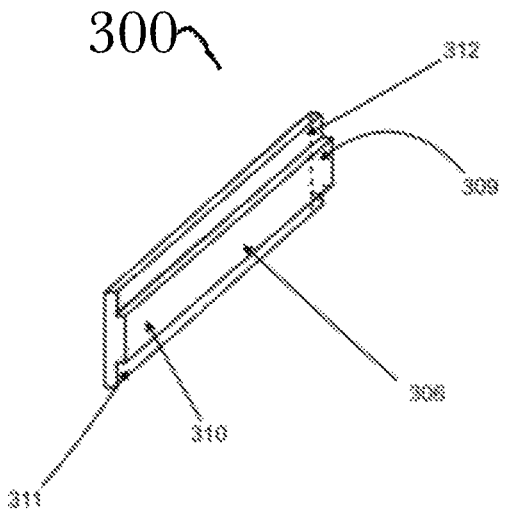
FIG. 3 shows a preferred embodiment of a slide component of a condition-sensing holster.

FIG. 3 shows a preferred embodiment of a slide component 300 of a condition-sensing holster. Slide component 300 may be extruded from, for example, aluminum, and comprises a raised surface 310 and two slide tongues 311 and 312. When raised surface 310 is flush or mounted against a flat surface, tongues 311-312 may be useable as slide rails. Surface 310 is generally aligned with holster body 106. Screws are inserted through holes 206, continuing through 106, and fastened into 306. When assembled beneath the inner plate 1515 of the handgun carriage 1515-1520, 300 is fastened to base plate 1505 and serves as a rail on which the handgun carriage slides during the loading procedure.

Figure 4:
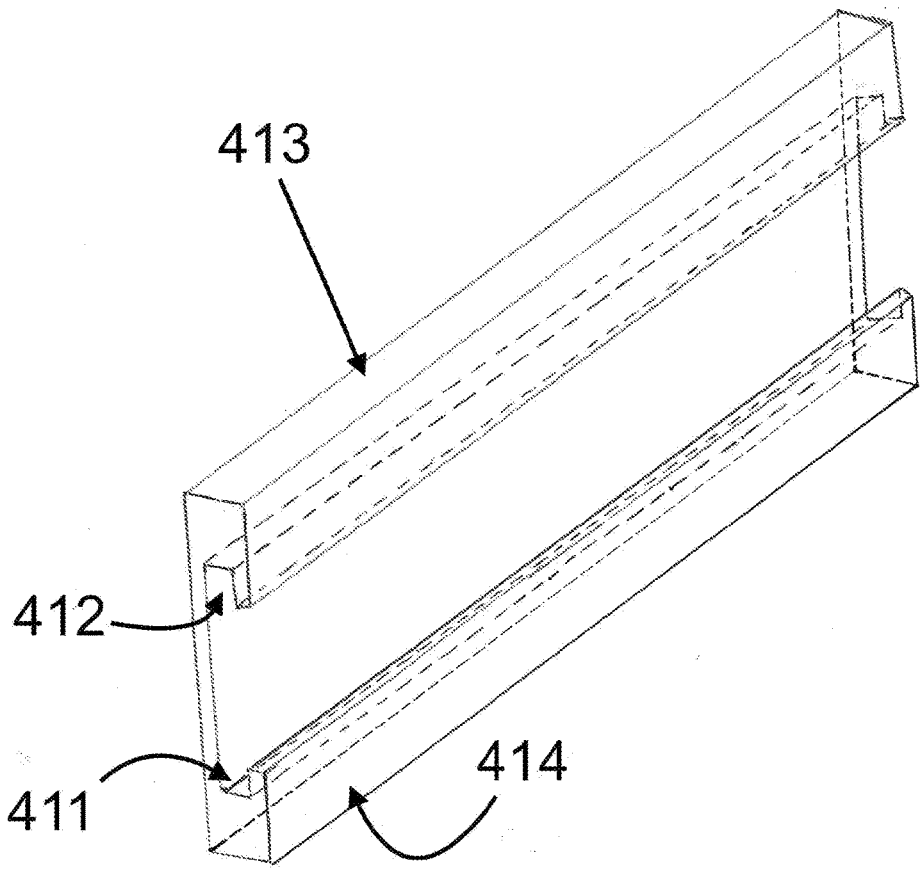
FIG. 4 shows a preferred embodiment of mountable rails present in a condition-sensing holster.

FIG. 4 shows a preferred embodiment of mountable rails present in a condition-sensing holster, specifically, slide component 400 with grooves 411-412 at each side 413,414 along its long axis. Slide component 400 is assembled onto the underside of the holster carriage base 1515 such that groove 412 fits around a tongue/rail of 300, possibly 312. Similarly, groove 411 fits around tongue/rail 311. In this way, slide component 400 forms a movable part that slides over the rails of 300 and allows the handgun carriage to move only in a parallel plane along the length of the holster base 1505 during the handgun loading operation 1600.

Figure 5:
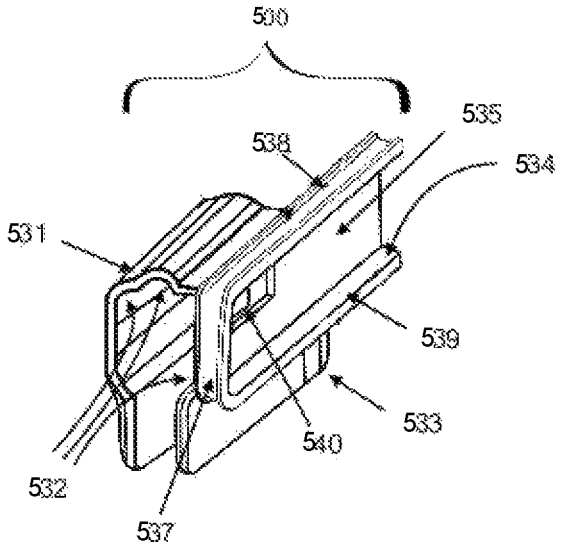
FIG. 5 is a preferred embodiment of a condition-sensing holster, showing a fitted pistol sleeve, and an externally grooved mount for slide components.

FIG. 5 is a preferred embodiment of a condition-sensing holster 500, showing a fitted pistol sleeve, and an externally grooved mount for slide components. Condition-sending holster 500 is formed such that it makes an elongated extruded plastic receiver for an intended handgun model 531, arcing to form a pair of opposing sides, each side having various grooves 532 to form a secure snug interaction with the handgun model for which it is specific. A portion of each side is deflected inward in order to form a trigger guard 533. Holster 500 also has a length of material 534, protruding from handgun carriage base's extended side 535 formed to create a U shape. The inner surface of the U shape forms a groove that extends around three of the four sides along the plane of carriage 537. Groove 537 has a bottom 538 and is designed to accommodate a strong elastomer band under tension, and may therefore include thickened walls 539, opposite each other. The extended side also has an access hole 540 that arm 1525 reaches through to access the gun's slide.

Figure 6:
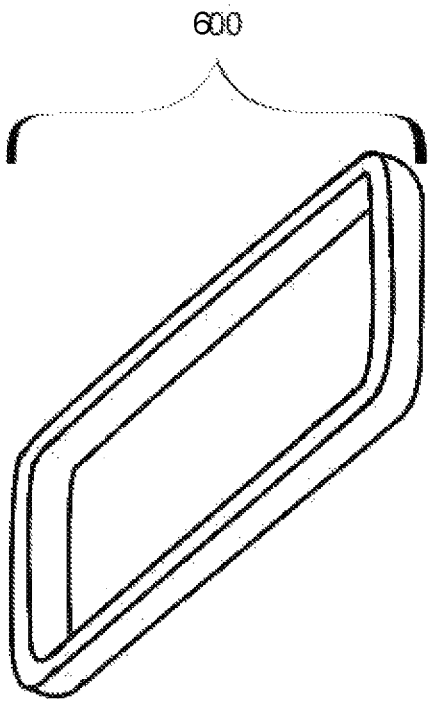
FIG. 6 shows a preferred embodiment of a molded silicone band which may be a replaceable part of the condition-sensing holster.

FIG. 6 shows a preferred embodiment of a molded silicone band 600 which may be a replaceable part of the condition-sensing holster. FIG. 6 shows, according to an embodiment, an elastomeric band 600, which may for example be made of silicone. It may be stretched such that it fits over holster body 500 and fits into a track comprised of grooves 103 and 537. This elastomer band 600 may thus retain the holster handgun carriage 500 in its resting position due to the compression energy of the elastomer material and provide both the resistance during owner action to load the enclosed handgun which returns the handgun and the carriage to the resting position once the owner decreases downward pressure, completing the load/unload process. Further, changing the polymer formulation of installed elastomer band may change the functional specifications of the holster as needed for changing environmental or owner ability conditions.

Figure 7:
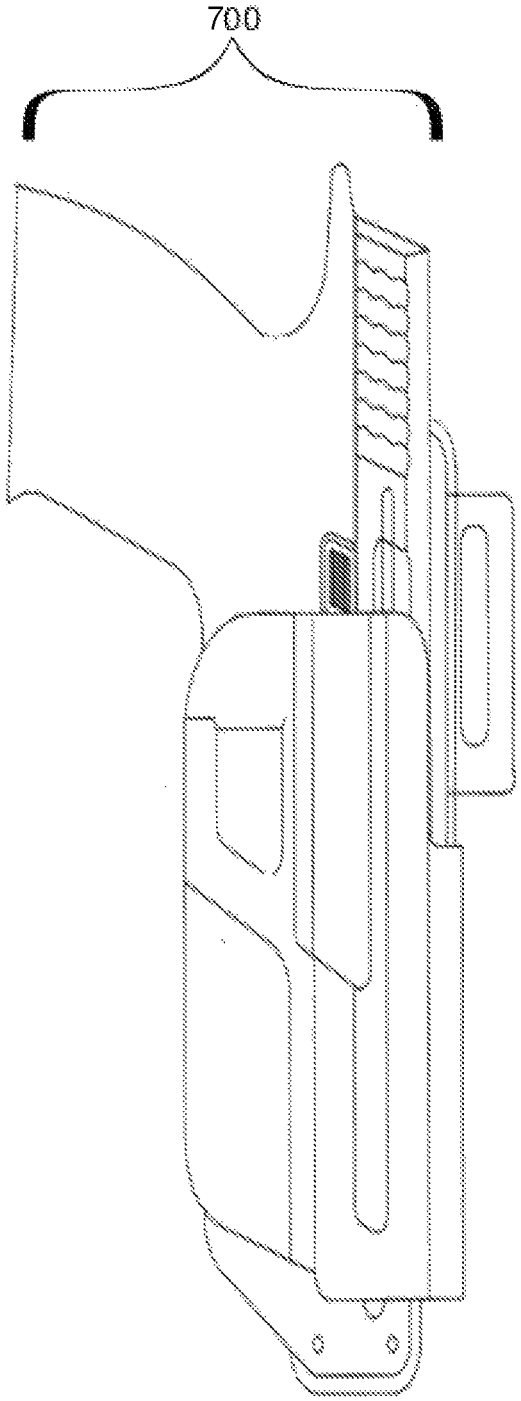
FIG. 7 shows an embodiment of a condition-sensing holster disposed at a first position.

FIG. 7 shows an embodiment of a condition-sensing holster 700 disposed at a first position. This is a normal positional state of the parts of condition-sensing holster 700. In this position, the elastomer band may be in its most relaxed state. This is also the position in which the handgun may be placed into, stored in and removed from the holster during use.

Figure 8:
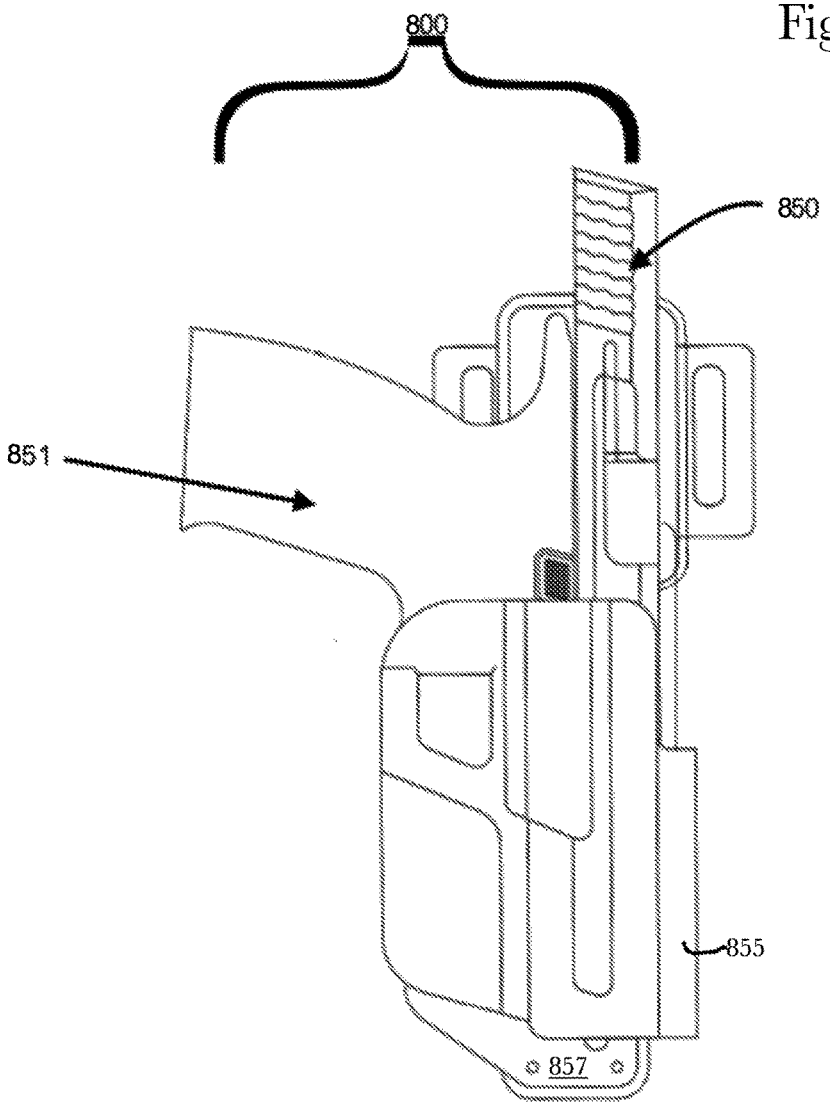
FIG. 8 shows an embodiment of a condition-sensing holster disposed at a second position.

FIG. 8 shows an embodiment of a condition-sensing holster 800 disposed at a second position. In the loading position shown, the handgun's 851 slide 850 has been stopped by base's arm 1525 from moving downward with the lower handgun carriage 855. In loading position, elastomeric band 600 may be exerting upward pressure to return handgun carriage 855 back to the resting position shown in FIG. 7. All the components of carriage's transport guide 300, 400, and 500 may be enclosed, away from the moving parts of handgun 851, thus significantly reducing the likelihood that holster assembly 800 will fail to load handgun 851 in a situation where that is the desired functionality.

Figure 13:
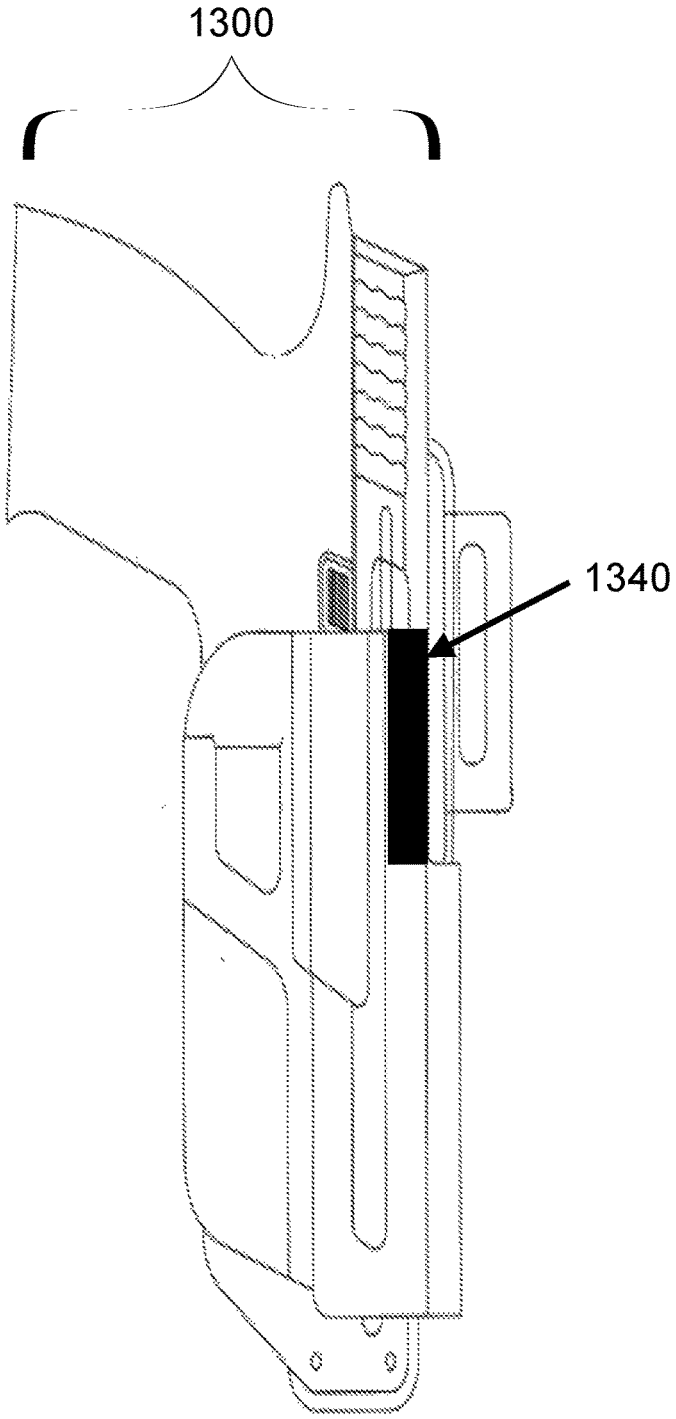
FIG. 13 depicts a condition-sensing feature of a condition-sensing holster, according to a preferred embodiment.

FIG. 13 depicts a condition-sensing feature of a condition-sensing holster, according to a preferred embodiment. According to the embodiment, holster 1300 may comprise a Bluetooth-enabled computing device 1340 attached to holster assembly 1300 in its storage position 700. Device 1340 may be pre-programmed to detect loading and unloading of a handgun 851 using a built-in microphone or other appropriate sensor. In other embodiments, this may be done with a camera or an LED reflective light source. A battery powers device 1340, which may store information locally, may transmit and may receive information wirelessly, may use at least one microphone to detect specific audio patterns such as gunshots, may transmit distinct audio patterns to communicate information, and may tag the location of sensed activity with GPS coordinates.

In other embodiments, device 1340 may be integrally formed within other components of holster 851 and may ascertain information based on the state of sensors activated based upon the relative position of the holster's components. For example, in some embodiments batteries and wireless transmission circuitry may be present in enclosures placed upon stabilization wings 121, 122.

Figure 14:
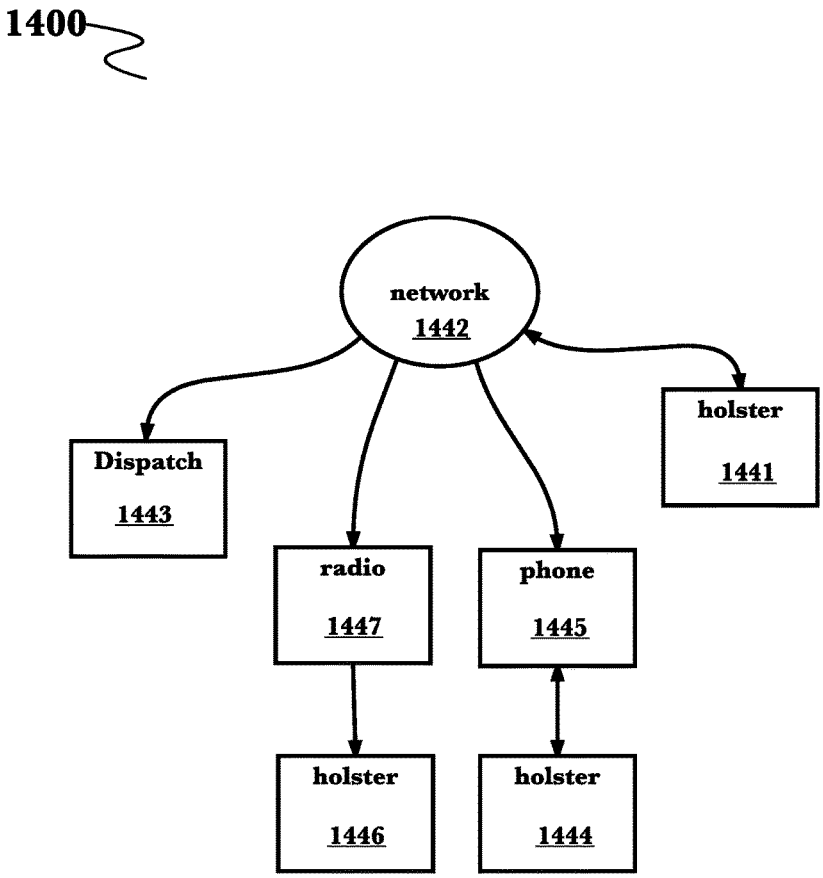
FIG. 14 depicts various arrangements of networked devices making use of a condition-sensing holster, according to an embodiment.

FIG. 14 depicts various arrangements of networked devices making use of a condition-sensing holster 1300, according to an embodiment. Condition-sensing holster 1300 may connect through a network 1442 to a dispatch station 1443. According to one embodiment, holster 1441 may connect directly to a network interface 1442 to a dispatch station 1443 with a reverse-compatible connection, which allows holster 1441 to be pinged and/or to receive messages in addition to sending them based on pre-programmed instructions.

In another embodiment, a holster 1444 may connect to a phone with Bluetooth, allowing for its configuration as well as connection to network 1442. A holster 1446 may connect through a radio into network 1442. When used in a law enforcement or similar monitored capacity, holster's connection increases the safety of a user by automatically alerting a dispatch station 1443 with a signal if specific conditions are met; conditions could include a microphone in device 1340 detecting someone loading and drawing a gun with and from the holster or a gunshot nearby. Device 1441 may be further configured to send an alert over a network 1442 to a dispatch station 1443 when, outside of certain given GPS coordinates, deviating from a certain route, a certain sound is made outside of an area, or the system recognizes certain voice commands, or detects a gun load.

Hardware Architecture

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit (ASIC), or on a network interface card.

Software/hardware hybrid implementations of at least some of the embodiments disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific embodiments, at least some of the features or functionalities of the various embodiments disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some embodiments, at least some of the features or functionalities of the various embodiments disclosed herein may be implemented in one or more virtualized computing environments (e.g., network computing clouds, virtual machines hosted on one or more physical computing machines, or other appropriate virtual environments).

Figure 9:
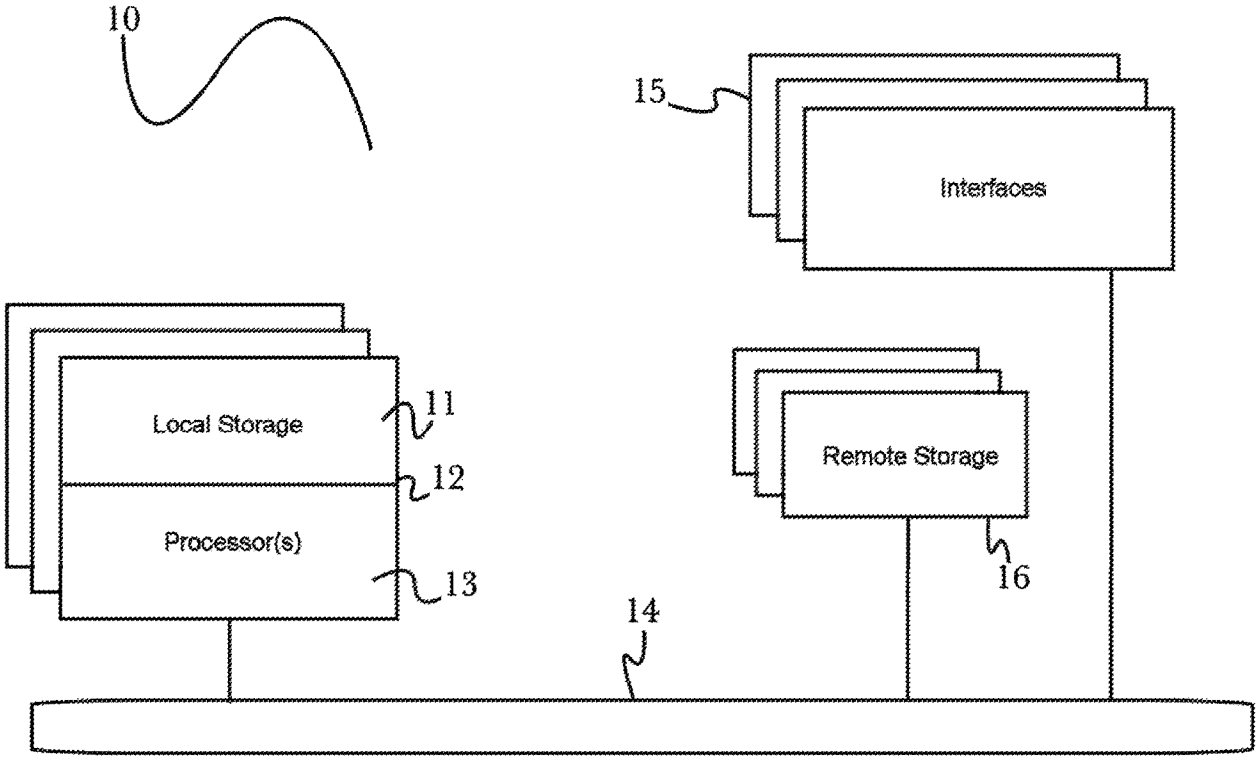
FIG. 9 is a block diagram illustrating exemplary hardware architecture of a computing device used in an embodiment.

Referring now to FIG. 9, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one embodiment, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one embodiment, a computing device 10 may be configured or designed to function as a server system utilizing CPU 12, local memory 11 and/or remote memory 16, and interface(s) 15. In at least one embodiment, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some embodiments, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a specific embodiment, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one embodiment, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (Wi-Fi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity A/V hardware interfaces) and, in some instances, volatile and/or non-volatile memory (e.g., RAM).

Although the system shown in FIG. 9 illustrates one specific architecture for a computing device 10 for implementing one or more of the inventions described herein, it is by no means the only device architecture on which at least a portion of the features and techniques described herein may be implemented. For example, architectures having one or any number of processors 13 may be used, and such processors 13 may be present in a single device or distributed among any number of devices. In one embodiment, a single processor 13 handles communications as well as routing computations, while in other embodiments a separate dedicated communications processor may be provided. In various embodiments, different types of features or functionalities may be implemented in a system according to the invention that includes a client device (such as a tablet device or smartphone running client software) and server systems (such as a server system described in more detail below).

Regardless of network device configuration, the system of the present invention may employ one or more memories or memory modules (such as, for example, remote memory block 16 and local memory 11) configured to store data, program instructions for the general-purpose network operations, or other information relating to the functionality of the embodiments described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein.

Because such information and program instructions may be employed to implement one or more systems or methods described herein, at least some network device embodiments may include non-transitory machine-readable storage media, which, for example, may be configured or designed to store program instructions, state information, and the like for performing various operations described herein. Examples of such non-transitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

Figure 10:
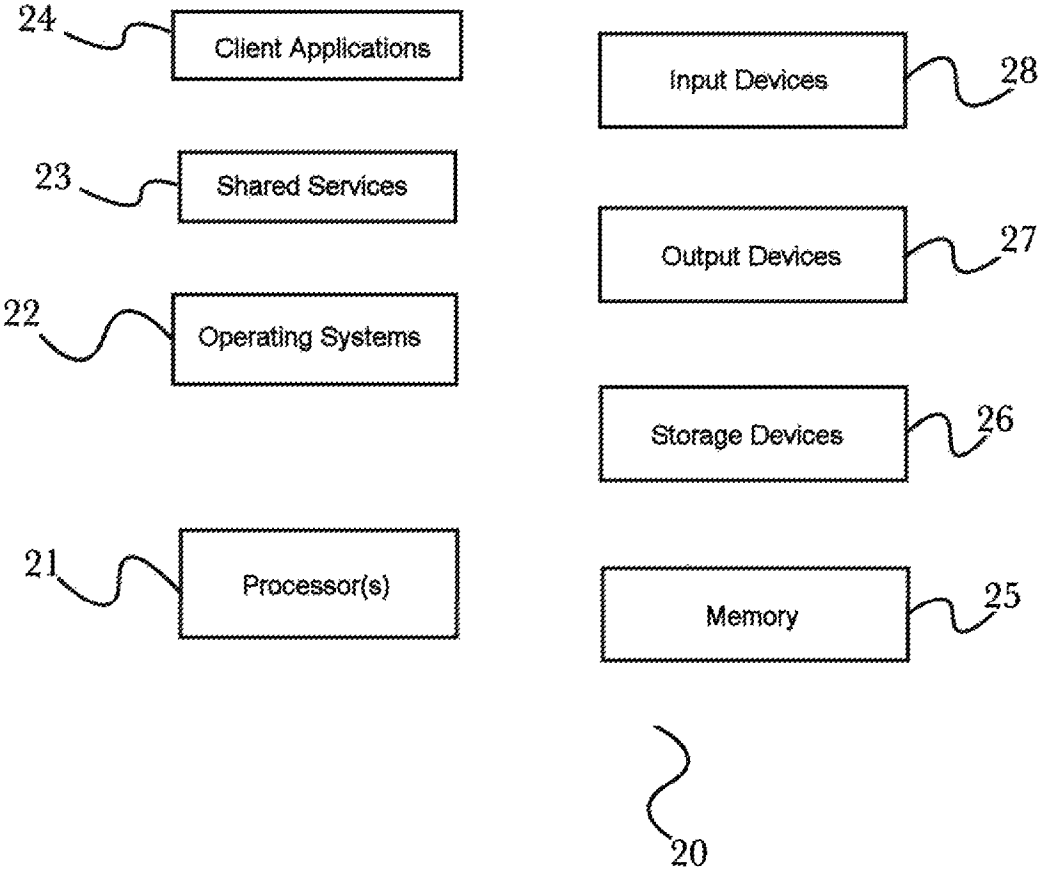
FIG. 10 is a block diagram illustrating an exemplary logical architecture for a client device, according to an embodiment.

In some embodiments, systems according to the present invention may be implemented on a standalone computing system. Referring now to FIG. 10, there is shown a block diagram depicting a typical exemplary architecture of one or more embodiments or components thereof on a standalone computing system. Computing device 20 includes processors 21 that may run software that carry out one or more functions or applications of embodiments of the invention, such as for example a client application 24. Processors 21 may carry out computing instructions under control of an operating system 22 such as, for example, a version of MICROSOFT WINDOWS™ operating system, APPLE OSX™ or iOS™ operating systems, some variety of the Linux operating system, ANDROID™ operating system, or the like. In many cases, one or more shared services 23 may be operable in system 20, and may be useful for providing common services to client applications 24. Services 23 may for example be WINDOWS™ services, user-space common services in a Linux environment, or any other type of common service architecture used with operating system 21. Input devices 28 may be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to system 20, and may include for example one or more screens for visual output, speakers, printers, or any combination thereof. Memory 25 may be random-access memory having any structure and architecture known in the art, for use by processors 21, for example to run software. Storage devices 26 may be any magnetic, optical, mechanical, memristor, or electrical storage device for storage of data in digital form (such as those described above, referring to FIG. 9). Examples of storage devices 26 include flash memory, magnetic hard drive, CD-ROM, and/or the like.

Figure 11:
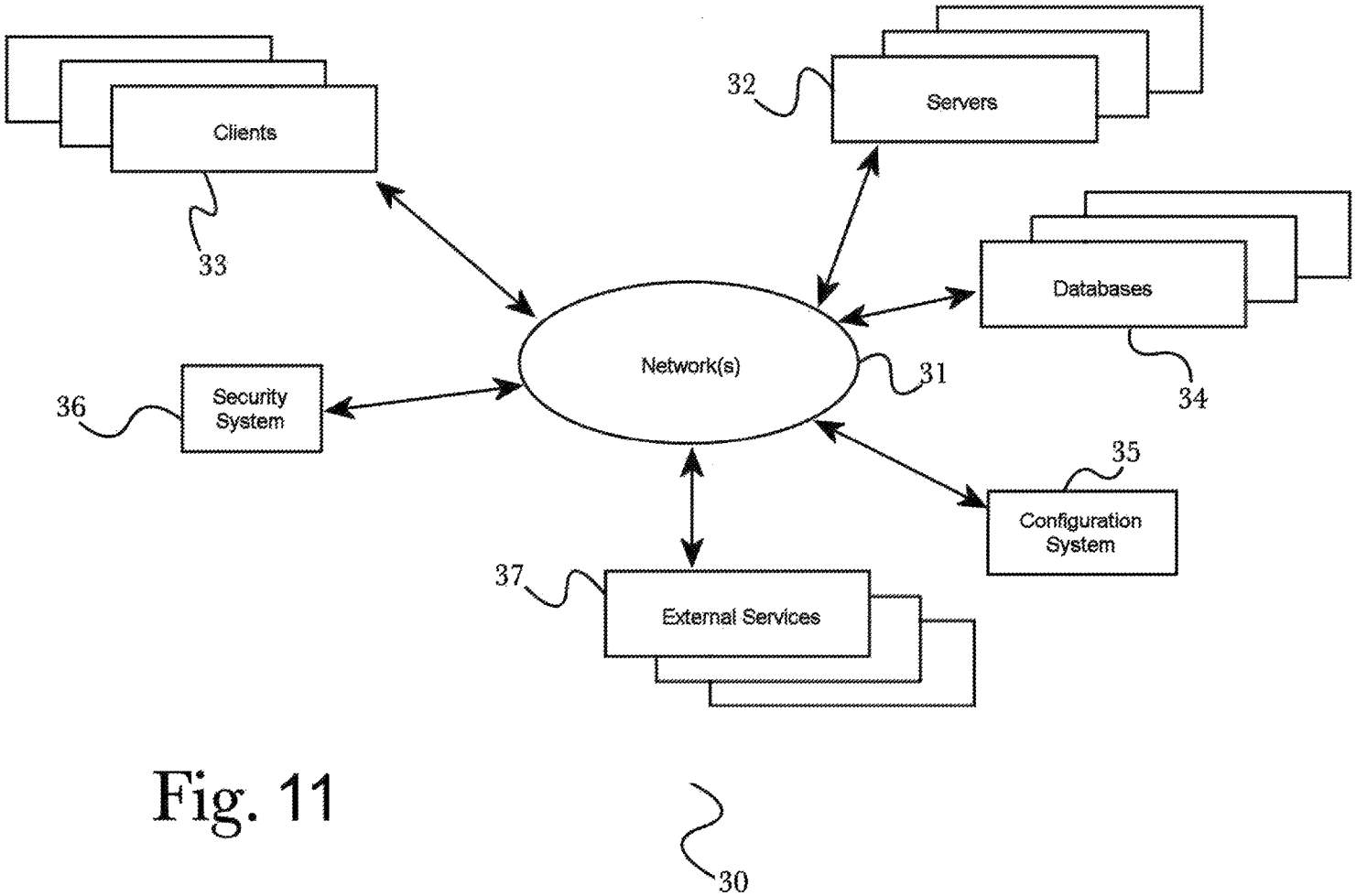
FIG. 11 is a block diagram showing an exemplary architectural arrangement of clients, servers, and external services, according to an embodiment.

In some embodiments, systems of the present invention may be implemented on a distributed computing network, such as one having any number of clients and/or servers. Referring now to FIG. 11, there is shown a block diagram depicting an exemplary architecture 30 for implementing at least a portion of a system according to an embodiment of the invention on a distributed computing network. According to the embodiment, any number of clients 33 may be provided. Each client 33 may run software for implementing client-side portions of the present invention; clients may comprise a system 20 such as that illustrated in FIG. 10. In addition, any number of servers 32 may be provided for handling requests received from one or more clients 33. Clients 33 and servers 32 may communicate with one another via one or more electronic networks 31, which may be in various embodiments any of the Internet, a wide area network, a mobile telephony network (such as CDMA or GSM cellular networks), a wireless network (such as Wi-Fi, WiMAX, LTE, and so forth), or a local area network (or indeed any network topology known in the art; the invention does not prefer any one network topology over any other). Networks 31 may be implemented using any known network protocols, including for example wired and/or wireless protocols.

In addition, in some embodiments, servers 32 may call external services 37 when needed to obtain additional information, or to refer to additional data concerning a particular call. Communications with external services 37 may take place, for example, via one or more networks 31. In various embodiments, external services 37 may comprise web-enabled services or functionality related to or installed on the hardware device itself. For example, in an embodiment where client applications 24 are implemented on a smartphone or other electronic device, client applications 24 may obtain information stored in a server system 32 in the cloud or on an external service 37 deployed on one or more of a particular enterprise's or user's premises.

In some embodiments of the invention, clients 33 or servers 32 (or both) may make use of one or more specialized services or appliances that may be deployed locally or remotely across one or more networks 31. For example, one or more databases 34 may be used or referred to by one or more embodiments of the invention. It should be understood by one having ordinary skill in the art that databases 34 may be arranged in a wide variety of architectures and using a wide variety of data access and manipulation means. For example, in various embodiments one or more databases 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some embodiments, variant database architectures such as column-oriented databases, in-memory databases, clustered databases, distributed databases, or even flat file data repositories may be used according to the invention. It will be appreciated by one having ordinary skill in the art that any combination of known or future database technologies may be used as appropriate, unless a specific database technology or a specific arrangement of components is specified for a particular embodiment herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, most embodiments of the invention may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with embodiments of the invention without limitation, unless a specific security 36 or configuration system 35 or approach is specifically required by the description of any specific embodiment.

Figure 12:
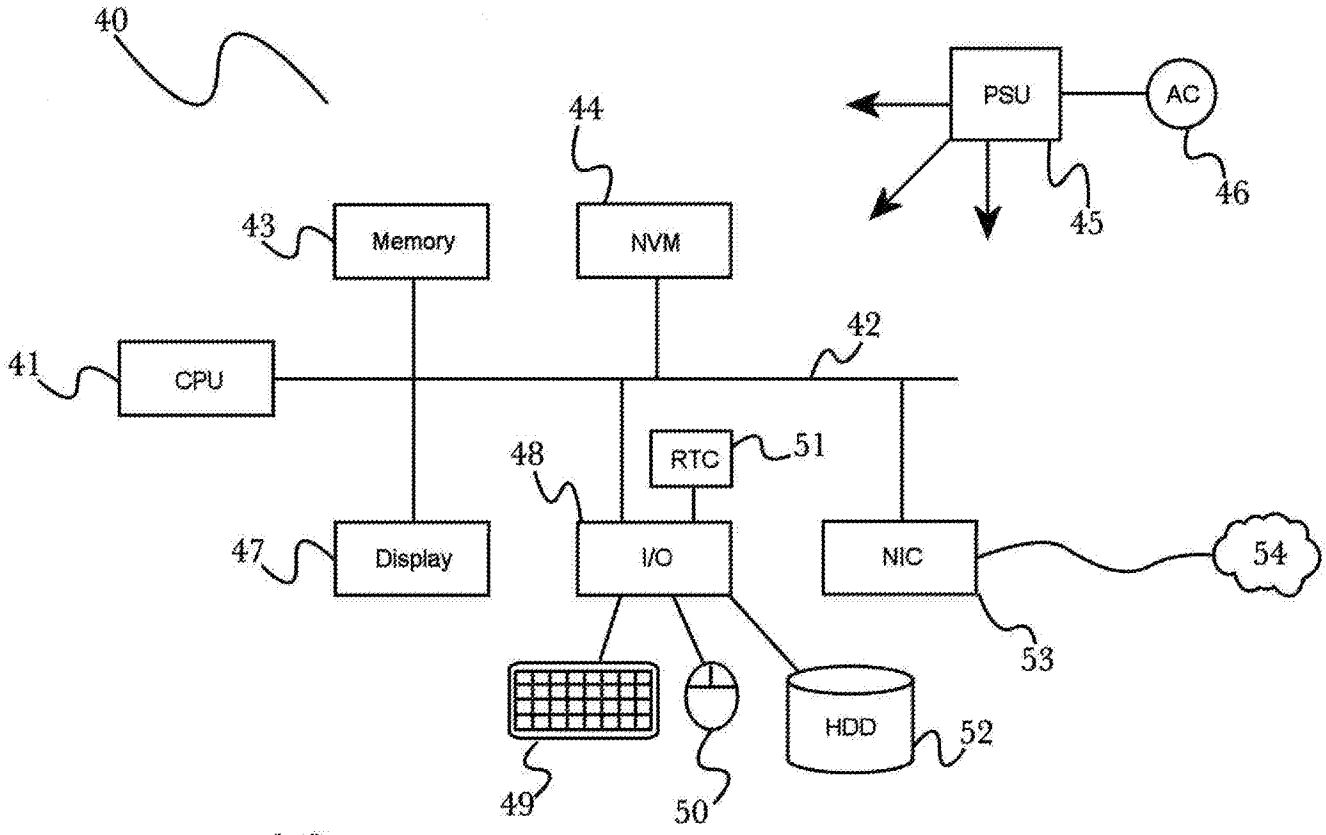
FIG. 12 is another block diagram illustrating exemplary hardware architecture of a computing device used in various embodiments.

FIG. 12 shows an exemplary overview of a computer system 40 as may be used in any of the various locations throughout the system. It is exemplary of any computer that may execute code to process data. Various modifications and changes may be made to computer system 40 without departing from the broader scope of the system and method disclosed herein. Central processor unit (CPU) 41 is connected to bus 42, to which bus is also connected memory 43, nonvolatile memory 44, display 47, input/output (I/O) unit 48, and network interface card (NIC) 53. I/O unit 48 may, typically, be connected to keyboard 49, pointing device 50, hard disk 52, and real-time clock 51. NIC 53 connects to network 54, which may be the Internet or a local network, which local network may or may not have connections to the Internet. Also shown as part of system 40 is power supply unit 45 connected, in this example, to a main alternating current (AC) supply 46. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In various embodiments, functionality for implementing systems or methods of the present invention may be distributed among any number of client and/or server components. For example, various software modules may be implemented for performing various functions in connection with the present invention, and such modules may be variously implemented to run on server and/or client components.

The skilled person will be aware of a range of possible modifications of the various embodiments described above. Accordingly, the present invention is defined by the claims and their equivalents.

What is claimed is:

1. A condition-sensing handgun holster, comprising:

a holster body configured to form an enclosure for a firearm;

a rigid arm comprising a structural member mounted within the holster body perpendicular to an orientation of a firearm placed within the holster body, and configured to operate at least a loading mechanism of a firearm placed within the holster body by obstructing the movement of at least a mechanical slide of the firearm while allowing movement of the firearm barrel along at least one axis; and a plurality of sensors configured to detect and report the state of a chamber of a firearm placed within the holster body, wherein the sensors are configured to report at least whether the chamber contains a live round of ammunition.

2. The holster of claim 1, further wherein at least a portion of the plurality of sensors is configured to report the presence of a firearm within the holster body.

3. The holster of claim 1, further wherein at least a portion of the plurality of sensors is configured to report data to a user's mobile device via a wireless network.

4. The holster of claim 1, wherein at least a portion of the holster body is constructed of a rigid, injection-molded polymer.

5. The holster of claim 1, wherein at least a portion of the holster body is constructed of a metal.

* * * * *